United States Patent [19]

Yamasaki

[11] Patent Number: 4,614,504

[45] Date of Patent: Sep. 30, 1986

[54] WALKING TOY VEHICLE WITH RAMP

[75] Inventor: Toshio Yamasaki, Long Beach, Calif.

[73] Assignee: Mattel, Inc., Hawthorne, Calif.

[21] Appl. No.: 755,116

[22] Filed: Jul. 15, 1985

[51] Int. Cl.[4] ..... A63H 3/22

[52] U.S. Cl. ..... 446/356; 446/335; 446/424

[58] Field of Search ..... 446/335, 336, 334, 356, 446/355, 354, 353, 352, 330, 427, 428, 462, 457, 424; 180/8.6, 8.5

[56] References Cited

U.S. PATENT DOCUMENTS

| | | | |
|---|---|---|---|
| 733,353 | 7/1903 | Bull | 446/356 |
| 2,667,719 | 2/1954 | Edwardson . | |
| 2,924,042 | 2/1960 | Byrtus . | |
| 3,559,336 | 2/1971 | Nozaki . | |
| 4,095,367 | 6/1978 | Ogawa . | |
| 4,177,602 | 12/1979 | Choi . | |
| 4,192,093 | 3/1980 | Hamano | 446/427 |
| 4,248,006 | 2/1981 | Jones et al. . | |
| 4,349,987 | 9/1982 | Bart . | |

FOREIGN PATENT DOCUMENTS

| | | | |
|---|---|---|---|
| 576396 | 3/1959 | Canada . | |
| 1077936 | 11/1954 | France | 446/356 |
| 719817 | 4/1954 | United Kingdom . | |

*Primary Examiner*—Mickey Yu

*Attorney, Agent, or Firm*—Ronald M. Goldman; Melvin A. Klein; John G. Mesaros

[57] ABSTRACT

A toy vehicle having a plurality of leg members driven by a motor, with a ramp at the rear end thereof positionable between a first position enabling loading of other vehicles thereon, and a second position for supporting the vehicle in an upright position, with actuation of the rear leg members engaging the supporting surface to rock the figure while motion of the other leg members simulate a boxing figure.

6 Claims, 9 Drawing Figures

WALKING TOY VEHICLE WITH RAMP

BACKGROUND OF THE INVENTION

The background of the invention will be discussed in two parts:

1. Field of the Invention

This invention relates to toy vehicles, and more particularly to a motorized walking toy vehicle with a ramp for enabling receipt and transportation of another toy vehicle, and for enabling folding of the ramp to support the vehicle in a sitting position.

2. Description of the Prior Art

Toy vehicles have been a source of amusement for decades, particularly the types of toy vehicles which provide some form of animation, motion, or flexibility in play situations. Some such vehicles are provided with appendages for simulating a walking movement.

One such early walking toy is shown and described in U.S. Pat. No. 733,353, issued July 7, 1903, to Bull, for "Toy", in which a toy in the form of an elephant is provided with a mechanism for walking.

Another such toy is shown and described in U.S. Pat. No. 2,667,719, entitled "Walking Doll Action", issued to Edwardson, on Feb. 2, 1954, the mechanism being provided with a pair of legs operated by a crank mechanism.

U.S. Pat. No. 3,559,336, is directed to a "Toy Having Capacitance Switch", and was issued to Nozaki on Feb. 2, 1971, and illustrates a mechanism for driving four legs in synchronism, with the motor device thereof activated by a capacitance switch.

U.S. Pat. No. 2,924,042, entitled "Walking Mechanisms", issued to Byrtus, on Feb. 9, 1960, suoh patent disclosing a four-legged mechanism with articulated appendages.

Another walking figure toy is shown and described in U.S. Pat. No. 4,095,367, issued to Ogawa, on June 20, 1978, such patent being entitled "Articulated Robot Assembly", the toy being a motor driven robot figure with removable legs, the figure then being attachable to accessory items.

Another such mechanism is shown in U.S. Pat. No. 4,177,602, issued Dec. 11, 1979 to Choi for "Automated Mechanism for Imparting Movement to Limbs of a Mechanical Toy", the patent disclosing a mechanism including a pair of articulated motor driven leg members.

U.S. Pat. No. 4,248,006, issued to Jones et al, on Feb. 3, 1981, and is entitled "Reconfigurable Moving Animal Simulating Toy", the toy having upper and lower body sections which are operatively attachable in a plurality of configurations.

U.S. Pat. No. 4,349,987, entitled "Doll Which Rises From Prone to Standing Position", was issued to Bart, on Sept. 21, 1982, and discloses a robot doll with motor driven movable arm and leg members for simulating walking and falling down with the mechanims enabling movement from a prone position to an erect position.

A "Mechanism for Animating Walking Dolls and the Like" is shown and described in Canadian Pat. No. 576,396, issued to Herbert E. Price, on May 26, 1959. In this patent, the toy is configured as a doll with an outer covering and an inner mechanism with articulated leg levers to simulate walking.

Another walking toy is shown and described in British Pat. No. 719,817, published Dec. 8, 1954, the patent being entitled "Improvements Relating to Walking Figures", with the doll thereof having a spring driven motor which drives the legs, as a unit from side to side.

It is an object of the present invention to provide a new and improved animated walking toy vehicle with a ramp.

It is another object of the present invention to provide a new and improved walking vehicle with a ramp which may be used to load other vehicles thereon.

It is a further object of the present invention to provide a new and improved motor driven four-legged toy vehicle with a ramp which may be positioned for support of the vehicle in a sitting position for simulating boxing when the motor is operated.

SUMMARY OF THE INVENTION

The foregoing and other objects are accomplished by providing a toy vehicle having a plurality of leg members driven by a motor, with a ramp at the rear end thereof positionable between a first position enabling loading of other vehicles thereon, and a second position for supporting the vehicle in an upright position, with actuation of the rear leg members engaging the supporting surface to rock the figure while the other leg members simulate a boxing motion.

Other objects, features and advantages of the invention will become apparent from a reading of the specification, when taken in conjunction with the drawings, in which like reference numerals refer to like elements in the several views.

DESCRIPTION OF THE PREFERRED EMBODIMENT

Figure 1:
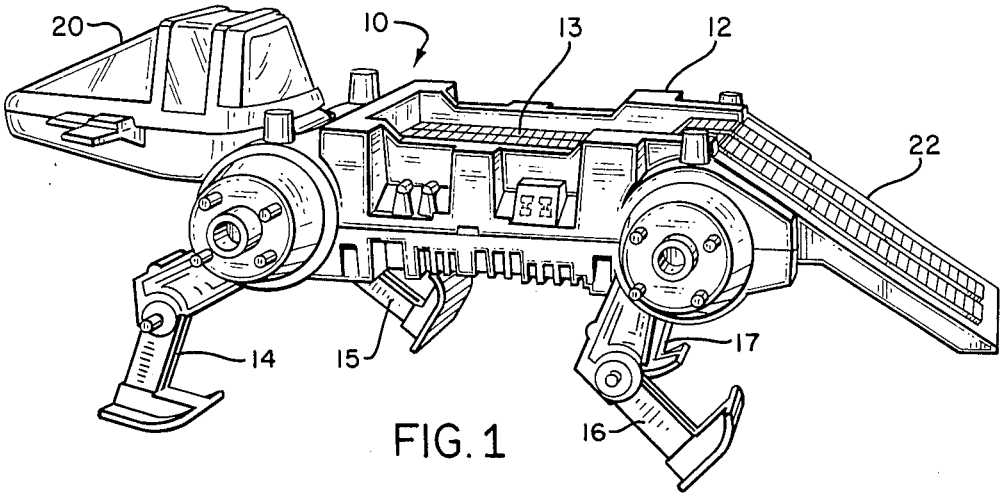
FIG. 1 is a perspective view of the walking toy vehicle with ramp in accordance with the present invention.
Figure 2:
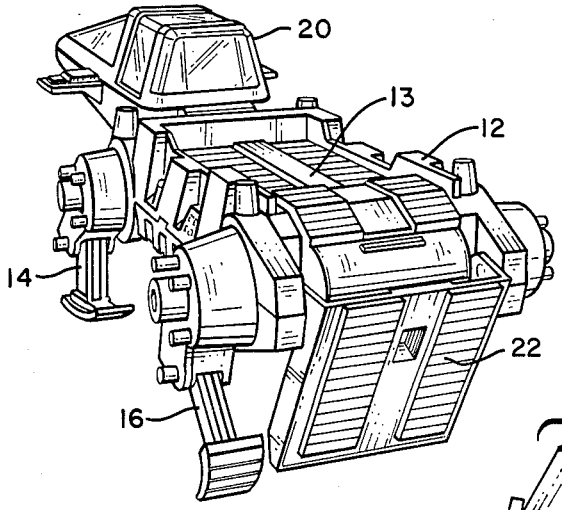
FIG. 2 is a rear perspective view, of the walking toy vehicle of FIG. 1, with the ramp thereof in a second position.

Referring now to the drawings, and particularly to FIGS. 1 and 2, there is shown a walking toy vehicle, generally designated 10, the vehicle 10 having a main central generally hollow body 12, front leg members 14, 15, rear leg members 16,17, a head member 20 attached to the body 12 at the front thereof, and a ramp member 22 hingedly coupled to the rear thereof.

The legs 14–17, as will be described, are pivotally coupled to the body 12, and driven by an electrically operated motor which is coupled to a gear drive mechanism for propelling the vehicle 10 on a surface. The body 12 has the upper surface 13 thereof generally planar for receiving thereon another vehicle (not shown) which may be driven up the ramp 22 when in the position depicted in FIG. 1. The ramp 22 is pivotable between first and second positions depicted in FIGS. 1 and 2, respectively, from the drive-up position, to the second position, which, as depicted in FIG. 3, supports the vehicle 10 in an upright position.

Figure 3:
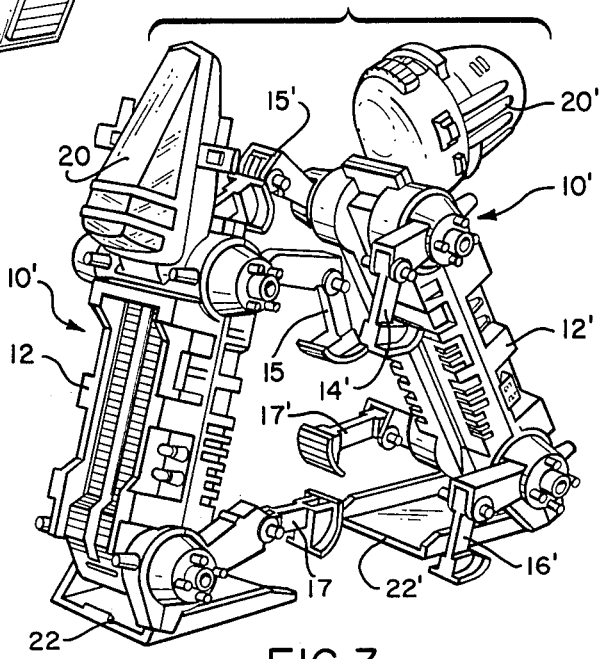
FIG. 3 is a perspective view depicting the walking toy vehicle of FIG. 1 in a generally upright postion, supported by the ramp thereof, with a similar second such vehicle adjacent thereto.

As shown in FIG. 3, two of such vehicles, designated 10 and 10', respectively, are in facing upright relation, and have the ramps 22 and 22' thereof, in the second, folded under position. In this position, with the motor driving the legs thereof, the rear legs 16 and 17 of vehicle 10, and the corresponding rear legs 16' and 17' of the vehicle 10', upon pivoting, slightly engage the floor to provide a slight rocking motion to the vehicles 10 and 10'. Simultaneously, the front legs 14 and 15 of vehicle 10, and the corresponding front legs 14' and 15' of vehicle 10' continue the pivoting motion, with the overall appearance being that of two behemoths engaged in a boxing contest. As will be discussed hereafter, the vehicle 10' is essentially identical to vehicle 10, with a different head member 20' attached thereto.

Figure 4:
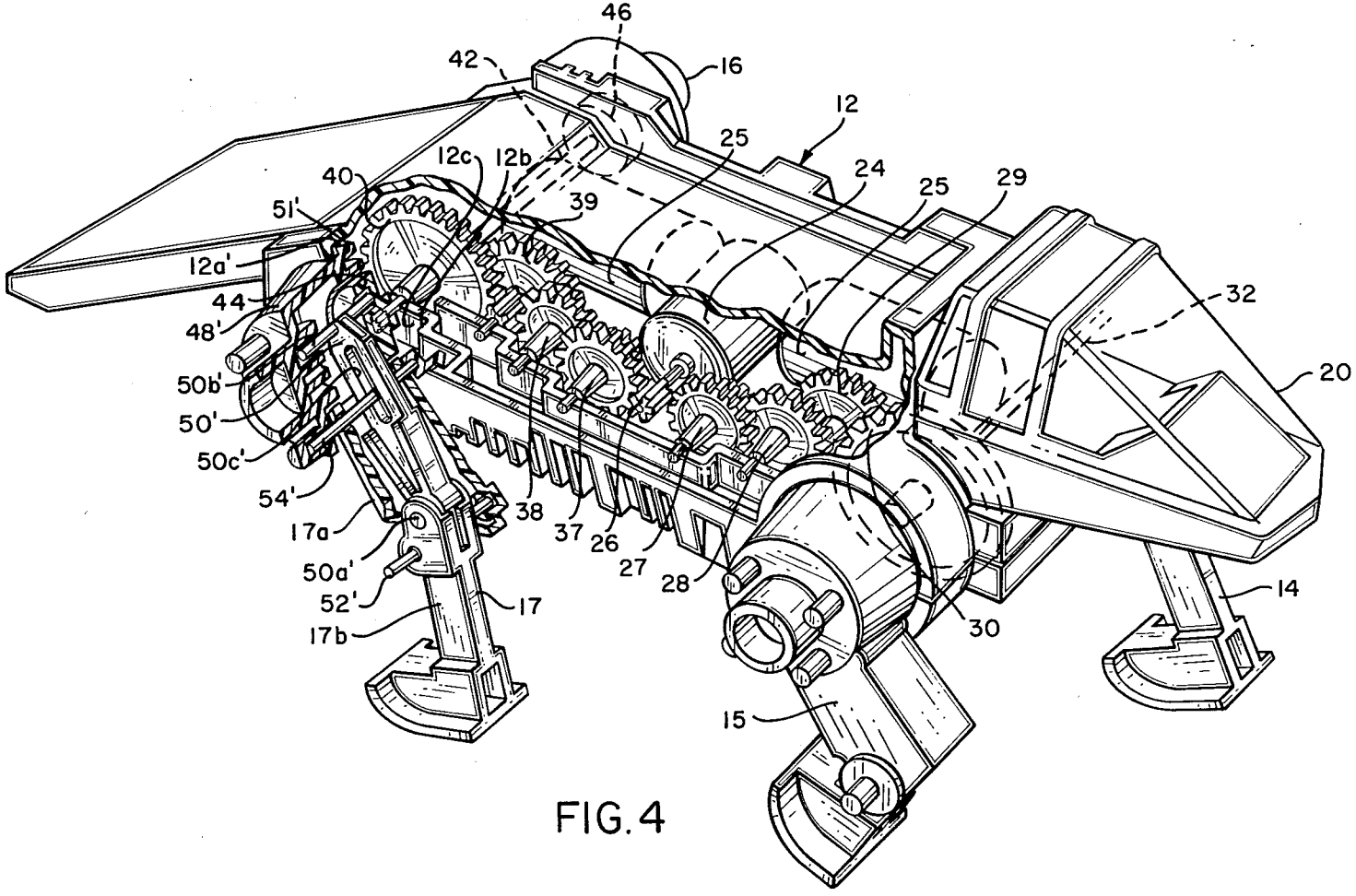
FIG. 4 is an enlarged perspective view of the vehicle of FIG. 1, partially in cross-section and partially broken away to illustrate the mechanism therein.
Figure 6:
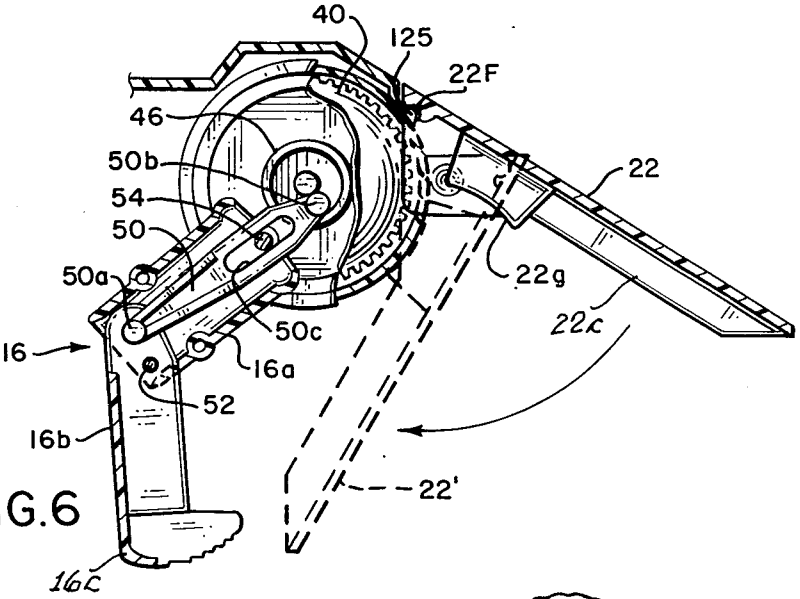
FIG. 6 is a partial side elevational view, partially in cross-section, of the rear leg and ramp portion of the walking toy vehicle of FIG. 1.
Figure 5:
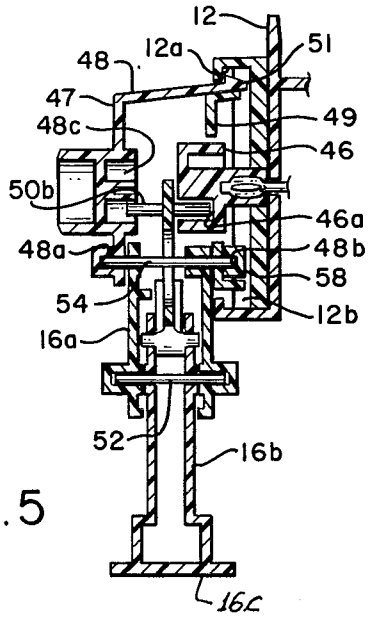
FIG. 5 is a partial cross-sectional view of one of the rear leg members of the walking toy vehicle of FIG. 1.

Referring now to FIGS. 4 through 6, as shown, the interior of the body 12 is provided with an electrical motor 24, coupled to first and second batteries 25, the motor 24 having a pinion gear 26 simultaneously driving first and second gear trains coupled to the front and rear legs 14–17. The gear train includes symmetrical forwardly and rearwardly extending gear arrangements. For example, the gear train for driving the front legs 14 and 15 includes spur gears 27–29 which provide gear reduction for the main driven gear 30, which is coupled to the axle 32 common to both front legs 14 and 15.

Similarly, the rear gear train includes spur gears 37–39 driven from the pinion 26, this gear train providing a like gear reduction for the rear main driven gear 40 which is coupled to the rear axle 42 common to both rear legs 16 and 17. Both ends of each axle 32 and 42 have coupled thereto for rotation therewith drive hubs, such as hubs 44 (shown in section) and 46 (shown in dotted lines) at the extremities of axle 42 on the exterior of the housing of the body 12.

Referring to FIGS. 5 and 6, as well as to FIG. 4, the leg members 14–17 are articulated assemblies, generally identically configured and include, by reference to FIGS. 5 and 6, an upper leg member **16*a*, a lower leg member 16*b* including an integrally formed arcuately bottomed foot portion 16*c*, a generally frusto-conically configured hollow cone member 48, and a slotted coupler member 50. The coupler member 50 is generally bar-shaped and provided with lower and upper transversely extending pivot projections 50*a* and 50*b*, and a longitudinally extending elongate slot 50*c***.

The leg assembly is coupled to the body 12 by means of the cone member 48, which is hollow with an outer surface 47, and an inner generally parallel portion 49 which is generally washer-shaped and provided with an inner opening for access for the operative leg components. The coupling edge 51 of cone 48 is enlarged in diameter and wedge shaped for detented fixed engagement within a well **12*a* formed in the body 12**.

The upper and lower leg members **16*a* and 16*b* are pivotably connected by a pivot pin 52. The upper leg member is generally hollow, and the upper end of lower leg member 16*b* extends therein, with the split end thereof being pivotably coupled to the transversely extending lower projection 50*a* on the coupler 50. The elongate slot 50*c* of the coupler 50 has passing therethrough a pivot pin 54 which extends between opposing walls of the hollow upper leg member 16*a*, the ends of pin 54 being retained in opposing apertures, such as aperture 48*a* formed in cone 48 and aperture 48*b*formed in projection 58. Thus, the upper leg member 16*a* is pivotably coupled to the cone 48**.

The hub 46 extends into the hollow interior of cone 48, where the upper transversely extending projection **50*b* of the coupler 50 has one end thereof inserted within an aperture 46*a* formed in drive hub 46 at a radial distance from the center thereof, thus providing an eccentric motion to the coupler 50. The other end of projection 50*b* is received within an annular slot 48*c* on the interior of the cone 48**.

In operation with rotation of the gear trains, the hub 46 rotates causing rotary motion of the upper end projection **50*b* of the coupler member 50, the other end of projection 50*b* tracking within the annular slot 48*c* of cone 48. The movement of coupler 50 is restrained at the connection of the pin 54 within the slot 50*c*. Since the pin 54 is coupled to cone 48, with cone 48 stationary within the well 12*a*, coupler 50 essentially rocks about the pin 54 while being generally vertically displaced within the limits of slot 50*c*. Simultaneously, the offset arm created by the distance between lower projection 50*a* of the coupler and the pivot pin 52 connecting the upper and lower leg members 16*a* and 16*b*, causes relative pivoting of the leg members as hub 46 rotates. To provide clearance for the movement of parts, two vertically extending edges 12*b* in the well 12*a* form a recessed portion 12*c* (See FIGS. 4 and 5**).

FIG. 4 depicts a leg member 17 in a perspective view which may be also be referred to for ease of understanding of the leg operating mechanism. The leg member 17 of FIG. 4 is identically configured and includes the upper and lower leg members **17*a* and 17*b*, respectively. To assist in the correlation of the operation thereof to the explanation above provided, the balance of the components have been provided with the same reference numerals as the leg assembly of FIGS. 5 and 6**, with the reference numerals followed by a prime.

Although not shown, the hubs 44 and 46 on opposite ends of axle 42 will have the eccentric apertures thereof circumferentially offset by one hundred eighty degrees, and similarly the eccentric apertures of hubs on the same side of the body 12 will be offset by the same amount, as a consequence of which legs 15 and 16 will be ascending as legs 14 and 17 are descending. The combined movement of all legs 14–17 provide a lumbering walking motion of the vehicle 10.

Figure 7:
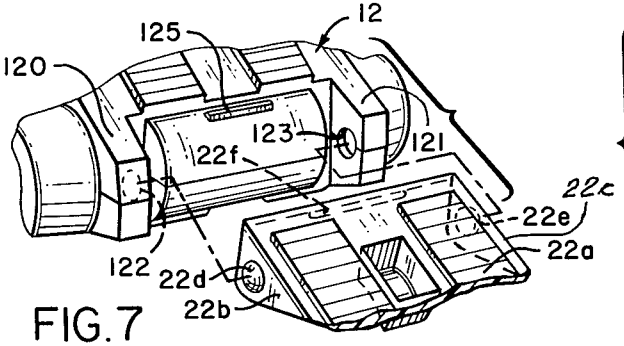
FIG. 7 is an exploded partial rear view of the walking toy vehicle of FIG. 1 illustrating the connection of the ramp thereof.

FIGS. 6 and 7 depict the details of the ramp 22, which has a generally planar surface **22*a* for movement of another vehicle thereon, and for supporting the vehicle 10 in an erect position as previously discussed. The ramp 22 has vertically depending sidewalls 22*b* and 22*c*, the connecting ends of which are provided with outwardly extending aligned dimples 22*d* and 22*e*. The rear of the body 12 has first and second rearwardly extending spaced projections 120 and 121 which have facing axially aligned apertures 122 and 123 formed therein for receiving the dimples 22***d* and 22*e*, respectively, for pivotable connection of the ramp 22 to the body 12.

For engagement and retention of the ramp 22 in the solid line position depicted in FIG. 6, the front edge of the ramp 22 is provided with a downwardly depending tab 22*f* which is positioned and dimensioned to engage an upwardly extending tab 125 formed on the body 12 generally centrally between projections 120 and 121. The parts of the toy vehicle 10 are formed of plastic material, such as by molding, and have a slight amount of resilience. The tabs 22*f* and 125 may be disengaged by slight force and the ramp 22 folded under, or pivoted downwardly to the dotted line position 22' shown in FIG. 6, at which point a bumper member 22*g* formed on the undersurface of ramp 22 engages against the adjacent undercarriage of body 12 to provide stability in the folded under position. In this position, it is to be emphasized that the length of the ramp 22 is such that it may be positioned in the dotted line position 22' while the vehicle 10 is in motion, without touching the supporting surface.

The length of ramp 22 is dimensioned and postioned so that in the folded under position of ramp 22', the foot portion of lower leg 16 defines an arc which extends through the plane of the upper surface of the ramp 22'. With the toy 10 positioned in an erect or upright position as shown in FIG. 3, the rear legs 16 and 17 will alternately engage the surface on which the vehicle 10 is supported, to thus provide a slight side to side rocking motion of the vehicle 10. At the same time the front legs 14 and 15 are being pivoted in a walking motion to simulate a boxing motion of the vehicles 10 and 10' shown therein.

Figure 9:
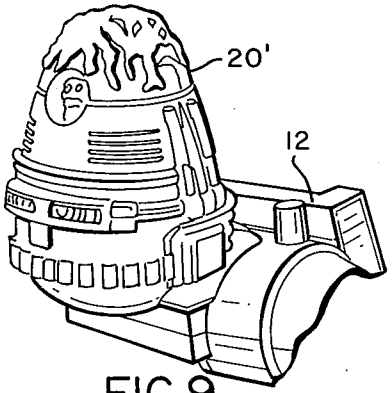
FIG. 9 is an exploded partial front view of the walking toy vehicle similar to FIG. 8 with an alternate head member attached thereto.
Figure 8:
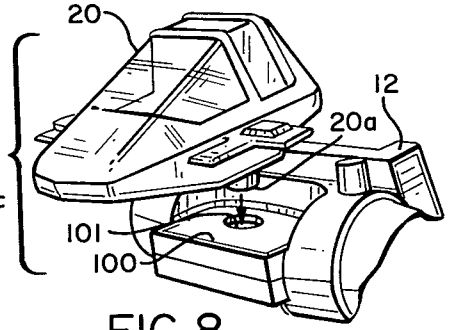
FIG. 8 is an exploded partial front view of the walking toy vehicle of FIG. 1, depicting the interconnection of the head member thereto.

As shown in FIGS. 8 and 9, the two vehicles 10 and 10' are not different, but are simply provided with two different head members 20 and 20', which are interchangeable on the same body 12. For this purpose, the forward end of body 12 is provided with a shelf 100 having a central aperture 101, into which may be inserted a supporting neck member 20*a* of the head 20. In accordance with the invention, a simulated behemoth in the form of a four-legged toy vehicle 10 has been described, with a mechanism for actuating the four legs 14–17 thereof in synchronism to enable walking, while a ramp 22, in a folded posption enables support of the behemoth with the front legs thereof simulating a boxing maneuver, while the rear legs thereof alternately engage the supporting surface to slightly rock the vehicle 10 during such boxing.

While there has been shown and described a preferred embodiment, it is to be understood that various other adaptations and modifications may be made within the spirit and scope of the invention.

I claim:

1. In a toy vehicle, the combination comprising:

a generally hollow body;

a first pair of leg means pivotally coupled to the front of said body;

a second pair of leg means pivotally coupled to the rear of said body;

motor operated means within said body coacting with said leg means to provide a walking motion; and means on the rear of said vehicle for supporting said vehicle on a surface with said body in a generally upright position, said supporting means including a ramp member pivotally coupled to said body rearwardly of said rear leg means, said ramp member and said rear leg means being positioned and dimensioned to enable alternate contact of each of said rear leg menas with the supporting surface to provide a rocking movement of said vehicle with the motor means operative, while enabling movement of said front leg means to simulate a boxing motion.

2. The combination according to claim 1 wherein said body includes a generally planar upper portion, and said ramp member is pivotable to a first position for enabling another toy vehicle to traverse said ramp for access to said planar upper portion.

3. The combination according to claim 2 wherein said ramp member is pivotable to a second position for supporting said body in a generally upright position.

4. The combination according to claim 3 wherein said body and said ramp member include coacting means for retaining said ramp in said first position.

5. The combination according to claim 4 wherein said leg means are articulated and said motor operated means includes an electrically operated motor and gear means.

6. The combination according to claim 4 wherein said coacting means includes aligned dimple means on said ramp member for engaging aligned apertures on said body.

* * * * *